US012723338B2

(12) United States Patent
Mcdonald

(10) Patent No.: US 12,723,338 B2
(45) Date of Patent: Sep. 1, 2026

(54) CLOTH OR RAG WASHING BUCKET FOR HOUSEHOLD, COMMERCIAL AND INDUSTRIAL USE

(71) Applicant: Tim Mcdonald, Missouri City, TX (US)

(72) Inventor: Tim Mcdonald, Missouri City, TX (US)

( * ) Notice: Subject to any disclaimer, the term of this patent is extended or adjusted under 35 U.S.C. 154(b) by 583 days.

(21) Appl. No.: 17/933,360

(22) Filed: Sep. 19, 2022

(65) Prior Publication Data

US 2023/0009917 A1 Jan. 12, 2023

Related U.S. Application Data

(63) Continuation-in-part of application No. 17/307,147, filed on May 4, 2021, now Pat. No. 12,245,734, which is a continuation-in-part of application No. 16/039,948, filed on Jul. 19, 2018, now Pat. No. 11,134,821, which is a continuation-in-part of application No. 15/993,913, filed on May 31, 2018, now Pat. No. 11,064,842, which is a continuation-in-part of application No. 14/877,519, filed on Oct. 7, 2015, now Pat. No. 10,456,812, which (Continued)

(51) Int. Cl.
*D06F 17/00* (2006.01)
*D06F 1/02* (2006.01)

(52) U.S. Cl.
CPC ..... *D06F 17/00* (2013.01); *D06F 1/02* (2013.01)

(58) Field of Classification Search
CPC ..... D06F 17/00
See application file for complete search history.

(56) References Cited

U.S. PATENT DOCUMENTS 5,113,881 A * 5/1992 Lin ..... A23N 12/02 134/1
5,309,587 A 5/1994 Fierro
(Continued)

FOREIGN PATENT DOCUMENTS

DE 29900545 U1 * 9/1999 ..... A47L 13/58
EP 2005846 A1 * 12/2008 ..... A23N 15/06
(Continued)

OTHER PUBLICATIONS

Machine translation of KR100741260B1, dated Jul. 19, 2007. (Year: 2007).*

(Continued)

*Primary Examiner* — Michael E Barr
*Assistant Examiner* — Kevin G Lee
(74) *Attorney, Agent, or Firm* — EGBERT, MCDANIEL & SWARTZ, PLLC

(57) ABSTRACT

A cloth or rag washing bucket has a container with an interior volume defined by a bottom and a wall extending upwardly from the bottom, a fluid inlet affixed adjacent the bottom of the container, a fluid outlet formed on the container at a level above the level of the fluid inlet. The inlet is adapted to be connected to a water hose. The fluid inlet extends through the wall of the container so as to have one end in the interior volume of the container and another end exterior of the wall of the container. The fluid outlet is adapted to allow water in the interior volume of the container to flow outwardly of the container.

15 Claims, 3 Drawing Sheets

Related U.S. Application Data is a continuation-in-part of application No. 14/812,545, filed on Jul. 29, 2015, now Pat. No. 9,408,412, which is a continuation-in-part of application No. 14/550,195, filed on Nov. 21, 2014, now Pat. No. 9,320,286.

(56) References Cited

U.S. PATENT DOCUMENTS 5,419,353 A * 5/1995 Chen ..... B08B 3/102 134/102.1
5,499,643 A * 3/1996 Vincent, Jr. ..... B08B 3/006 134/155
6,009,585 A 1/2000 Middleton
6,158,258 A 12/2000 Bowman
6,283,170 B1 * 9/2001 Robinson ..... A47L 7/0009 15/260
6,374,867 B1 * 4/2002 Maiuro ..... A47J 47/18 141/2
6,568,409 B1 * 5/2003 Fleck ..... B08B 3/12 134/186
8,042,215 B2 10/2011 Thibault
10,773,279 B2 9/2020 McDonald
2002/0166578 A1 * 11/2002 Leblond ..... B01D 41/04 134/140
2007/0271708 A1 11/2007 Feinberg
2009/0265871 A1 * 10/2009 Wooten ..... A47L 13/20 15/118
2009/0266381 A1 * 10/2009 Soderquist ..... A61B 90/70 134/25.1
2014/0127986 A1 * 5/2014 Cady ..... A22C 17/08 452/173

FOREIGN PATENT DOCUMENTS

KR 100741260 B1 * 7/2007
WO 0208508 A 1/2012

OTHER PUBLICATIONS

Machine translation of KR100741260B1, dated Jul. 2006. (Year: 2006).*
Machine translation of DE-29900545-U1, dated Sep. 2, 1999. (Year: 1999).*

* cited by examiner

CLOTH OR RAG WASHING BUCKET FOR HOUSEHOLD, COMMERCIAL AND INDUSTRIAL USE

CROSS-REFERENCE TO RELATED APPLICATIONS

The present application is a continuation-in-part of U.S. patent application Ser. No. 17/307,147, filed on May 4, 2021, and entitled "Mop Washing Bucket for Household, Commercial, and Industrial Use", presently pending. U.S. patent application Ser. No. 17/307,147 is a continuation-in-part of U.S. patent application Ser. No. 16/039,948, filed on Jul. 19, 2018, and entitled "Washing Bucket for Household, Commercial and Industrial Use for Cleaning Mops". U.S. patent application Ser. No. 16/039,948 issued as U.S. Pat. No. 11,134,821 on Oct. 5, 2021. U.S. patent application Ser. No. 16/039,948 is a continuation-in-part of U.S. patent application Ser. No. 15/993,913, filed in May 31, 2018 and entitled "Washing Bucket for Household, Commercial and Industrial Use for Cleaning Mops and for Chemical Cleaning" U.S. patent application Ser. No. 15/993,913 issued as U.S. Pat. No. 11,064,842 on Jul. 20, 2021. U.S. patent application Ser. No. 15/993,913 is a continuation-in-part of U.S. patent application Ser. No. 14/877,519, filed on Oct. 7, 2015, and entitled "Apparatus and Method for Washing Meat and/or Produce". U.S. patent application Ser. No. 14/877,519 issued as U.S. Pat. No. 10,456,812 on Oct. 29, 2021. U.S. patent application Ser. No. 14/877,519 is a continuation-in-part of U.S. patent application Ser. No. 14/812,545, filed on Jul. 29, 2015, and entitled "Apparatus and Method for Cleaning Produce". U.S. patent application Ser. No. 14/812,545 issued as U.S. Pat. No. 9,408,412 on Aug. 9, 2016. U.S. patent application Ser. No. 14/812,545 is a continuation-in-part of U.S. patent application Ser. No. 14/550,195, filed on Nov. 21, 2014. U.S. patent application Ser. No. 14/550,195 issued as U.S. Pat. No. 9,321,286 on Apr. 26, 2016 and is entitled "Apparatus and Method for Cleaning Game".

BACKGROUND OF THE INVENTION

1. Field of the Invention

The present invention relates to washing buckets. More particularly, the present invention relates to buckets wherein cloths and rags can be washed. Additionally, the present invention relates to cloth or rag washing buckets in which a continuous supply of fresh water is provided during the washing and rinsing of the cloth or rag. The present invention also relates to relatively small washing buckets that can be used without wheels or wringing attachments.

2. Description of Related Art Including Information Disclosed Under 37 CFR 1.97 and 37 CFR 1.98

When cleaning surfaces with a cleaning cloth or rag, it is usual to use a detergent or cleaning agent of the water used for rinsing the cleaning cloth. The detergent and helps to dissolve grease and lift dirt from the surface. For convenience, the rinsing water and the detergent are held in a bucket which can be moved around easily as the surfaces cleaned. Whenever the cleaning cloth becomes heavily loaded with dirt, it is rinsed out in the bucket and wrung dry to transfer dirt from the cleaning fabric into the water.

Although not readily appreciated, this cleaning technique is far from efficient. Each time the clean cloth is rinsed, some dirt is transferred into the water. After several rinsing cycles, the rinsing water becomes loaded with dirt. As a result, it is impossible to rinse the cleaning cloth effectively. Detergents, which are considered essential with most cleaning fabrics to clean the surface and the cleaning fabric itself, can actually add to the problems. Not only do detergents leave a film of dirt and detergent on the surface, which has been cleaned, but they also hold the dirt in the rinsing water thereby allowing it to be picked up on the cleaning cloth each time it is rinsed. Only by changing the water regularly can the problem be overcome satisfactorily.

Moreover, detergents and cleaning agents are, almost without exception, damaging to the environment and costly. As such, a need has developed so as to provide a way of cleaning cloths and rags wherein detergents are avoided and in which the cloth can be rendered clean in a relatively short period of time.

In the past, various patents and patent application publications have issued with respect to the cleaning of rags and cloths used in household, commercial and industrial settings. For example, U.S. Pat. No. 5,309,587, issued on May 10, 1994 to J. V. Fierro, teaches an industrial rag cleaning process for the removal of petroleum-based solvents in an environmentally-safe manner. The industrial rags are initially subjected to high-speed forces in a rotary drum to physically extract the liquid solvent. The high-speed extraction step is conducted while preferably maintaining a temperature within the drum a below the flashpoint of the petroleum-based solvent. Next, the rags are tumbled while being subjected to intermediate blasts of cold air and hot air to vaporize solvent remaining in the rags. The vapors are routed from the drum and condensed. The extracted liquid solvent and condensed solvent vapors are both routed to a waste solvent collection line. The industrial rags are finally dried to produce clean rags suitable for reuse.

U.S. Pat. No. 6,009,585, issued on Jan. 4, 2000 to R. G. Middleton, describes an apparatus for washing shop cloths. This apparatus has a hot water storage tank, a washer that washes, rinses, centrifuges and dries, and an evaporator for evaporating effluent from the washer. The washer rotates about a horizontal axis when washing, rinsing, drying and centrifuging, but at different speeds depending on whether it is centrifuging or washing, rinsing or drying. In use, the washer is loaded and then the load is centrifuged to remove fluids present in the cloths. The effluent is discharged to the evaporator. The load is then washed in hot water from a hot water storage tank along with biodegradable degreasers and soaps. After draining the washer to the evaporator, the load is centrifuged. The washer undergoes a rinse cycle, draining the rinse water to the water heater through a filter for reuse, and finally a tumble dry cycle.

U.S. Pat. No. 6,158,258, issued on Dec. 12, 2000 to D. A. Bowman, discloses a rinsing system that has a container for use in rinsing out dirt from cleaning cloth. This container includes a compartment adapted to hold water, a means for providing fresh water, a structure adapted to receive the cleaning cloth to be rinsed, and at least one nozzle for supplying water free of dirt onto the cleaning cloth.

U.S. Pat. No. 8,042,215, issued on Oct. 25, 2011 to R. R. Thibault, provides a cleaning system for removing a braiding material adapted to remove and keep separated abrasive contaminants from a wash rag, mitt, or brush. This cleaning system is capable of being mounted within a standard five gallon bucket for the purposes of washing a car, a boat, a recreational vehicle or the like. The cleaning system is a lattice structure including a scrubber grate which is positioned within the bucket such that a wash rag, mitt or long-handled brush is capable of being vigorously rubbed against the scrubber grate such that any abrasive grit or contaminants within the wash rag, mitt, or long-handled brush will become dislodged and settle to the bottom of the cleaning fluid within the bucket. The lattice structure also has a receiver base to support the scrubber grate and is located near the bottom of the bucket. The lattice structure receiver base allows abrasive contaminants and debris to settle to the bottom of the bucket.

U.S. Patent Application Publication No. 2007/0271708, published on Nov. 29, 2007 to I. A. Feinberg, discloses a method of repetitively conditioning cleaning cloths with a cleaning solution. Window cleaning cloths are repetitively conditioned for cleaning windows in a commercial carwash by processing the cloths in a washer-extractor of the type having, in sequence, a wash cycle, a first rinse and spin cycle, and a final rinse-and-spin cycle. A detergent and degreaser are added to the water used in the wash cycle. A window cleaning solution is added to the final rinse water used in the final rinse-and-spin cycle to saturate the cloths with a diluted mixture of water and window cleaning solution. A substantial portion of the diluted mixture of final rinse water and window cleaning solution is removed during the spin portion of the final rinse-and-spin cycle to provide a window cleaning cloth uniformly dampened with window cleaning solution.

International Publication No. WO 02/08508, published on Jan. 31, 2012, describes a circulation method for the environmentally friendly cleaning of contaminated textiles, especially industrial cleaning rags that are contaminated with solvent residues. The articles to be cleaned are supplied in a manner to an industrial washing machine. After washing, they are transferred to a drier. The collected air currents extracted from the industrial washing machine and/or the drier are transported to an oxidation chamber and oxidized. The energy of the chamber is applied to a steam generator that communicates with a device for pre-heating the washing water and a waste water purification installation so that the wastewater can be evaporated and thus purified. The industrial water purified in this manner can be returned to the industrial washing machine.

U.S. Pat. No. 10,773,279, issued on Sep. 15, 2020 to the present inventor was a great improvement in the field of mop washing buckets. This washing bucket has a container with an interior defined by a wall and a bottom, a fluid inlet affixed to the wall of the container and communicating with the interior of the container, and a fluid outlet opening to the wall of the container and positioned at a level higher than a level of the fluid inlet. The fluid inlet is positioned adjacent to the bottom of the container. The fluid inlet has a connector positioned exterior of the wall of the container and is adapted to connect to a water hose. The fluid outlet has a diameter greater than the diameter of the fluid inlet. The fluid outlet has a pipe affixed to the wall of the container.

In this prior patent to the present inventor, the mop washing bucket worked in an excellent fashion for use in removal of dirt and debris from the strings of mops. However, an issue developed with respect to the use of such a mop bucket in very small facilities, such a small convenience stores, small fast food restaurants, and other commercial operations that operate in a very restricted space. It was found that the mop washing bucket of this prior patent, along with conventional prior art mop washing buckets, have a large footprint and occupy a relatively large area. The mere size of prior art mop washing buckets would occupy enough space so as to be a major inconvenience to the day-to-day operations of such small facilities. Additionally, under certain circumstances, the small facilities would have a relatively small sink in the janitorial closet. As such, it would become difficult to actually place such a mop washing bucket, in its entirety, within such a small sink. As such, need developed so as to provide a relatively small mop washing bucket that occupied a minimal amount of space in small facilities and which can be readily placed in small sinks.

After experimentation with the mop washing bucket of this prior application, it was found that while effective in cleaning the strings of mops, it was also effective in removing dirt, debris and contaminants from rags and cloths and placed into this mop washing bucket. There is a need in small facilities, such as restaurants, to repetitively clean cloths that are used for the cleaning of tables. Also, there is a need to clean these cloths without resorting to detergents and anti-greasing agents.

It is an object of the present invention to provide a cloth or rag washing bucket that effectively cleans the cloths or rags.

It is another object of the present invention provide a cloth or rag washing bucket that accommodates the cleaning of multiple rags simultaneously.

It is another object of the present invention to provide a cloth or rag washing bucket that avoids the use of detergents and other degreasing materials.

It is still a further object to the present invention to provide a cloth or rag washing bucket that effectively prevents the accumulation of dirt and debris on the cloth or rag.

It is still a further object of the present invention to provide a cloth or rag washing bucket which is easy to use.

It is another object of the present invention to provide a cloth or rag washing bucket which is relatively inexpensive.

It is still another object of the present invention to provide a cloth or rag washing bucket that has a relatively small footprint.

It is still another object of the present invention to provide a cloth or rag washing bucket which allows the cloths or rags to be continuously reused.

It is still another object of the present invention provide a cloth or rag washing bucket that enhances the life of use of the cloths or rags.

It is still another object of the present invention to provide a cloth or rag washing bucket which allows debris and dirty water to be directed to a specific location exterior of the washing bucket.

It is still another object of the present invention to provide a cloth or rag washing bucket which conserves water.

It is still a further object of the present invention to provide a cloth or rag washing bucket whereby a continuous supply of clean hot water is maintained within the interior of the washing bucket.

These and other objects and advantages of the present invention will become apparent from a reading of the attached specification and appended claims.

BRIEF SUMMARY OF THE INVENTION

The present invention is a cloth or rag washing bucket that comprises a container having an interior volume defined by a bottom and a wall extending upwardly from the bottom, a fluid inlet affixed adjacent to the bottom of the container, and a fluid outlet formed on the container in a location above the fluid inlet. The fluid inlet is adapted to be connected to a water hose. The fluid inlet extends through the wall of the container so as to have one end in the interior volume and another end exterior of the wall of the container. A fluid outlet is adapted to allow water from the interior volume of the container to flow outwardly of the container.

The wall of the container has a pair of side walls and a pair of end walls extending between the pair of side walls so as to have a generally rectangular configuration. Each of the pair of side walls has a width dimension extending between the pair of end walls. Each of the pair of end walls has a width dimension extending between the pair of side walls. The width dimension of each of the pair of side walls is greater than a width dimension of each of the pair of end walls.

The fluid inlet comprises a fitting affixed in one of the pair of end walls. The fitting has a hose fitting on an end exterior of the end wall and a nozzle on the end of the fitting in the interior volume of the container. The nozzle of the fitting is a slot having a length dimension extending parallel to the bottom of the container and a width dimension extending transverse to the bottom of the container. The length dimension of the slot is substantially greater than the width dimension of the slot. The width dimension of the slot is greatest between the opposite ends of the length dimension of the slot. In the preferred embodiment the present invention, the slot has a truncated ellipsoid shape.

The fluid outlet comprises an opening formed in the wall of the container. In particular, in the preferred embodiment of the present invention, the fluid outlet is a tubular member extending outwardly of the hole of the wall of the container. The tubular member is adapted to allow water to flow outwardly from the container at a location spaced away from the wall of the container. In the preferred embodiment of the present invention, the tubular member has ridges thereon. These ridges are adapted to retain a conduit or hose over an end of the tubular member.

In an embodiment of the present invention, the fluid inlet and the fluid outlet will be on a common wall of the container. A pair of feet are affixed to the bottom of the container so as to extend outwardly from the bottom of the container. The plurality of feet are adapted to support the container in spaced relation above an underlying surface. A water hose can be connected to the fluid inlet. The fluid inlet defines a nozzle that directs water under pressure from the water hose into the interior volume of the container in a bottom-to-top circular pattern.

In an other embodiment of the present invention, the fluid outlet comprises a pipe affixed to the wall of the container. The pipe has an end extending outwardly of the wall of the container. This pipe can have an L-shaped configuration. In particular, the pipe can be pivotally mounted to the container such that an end of the pipe can be directed in a desired direction.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
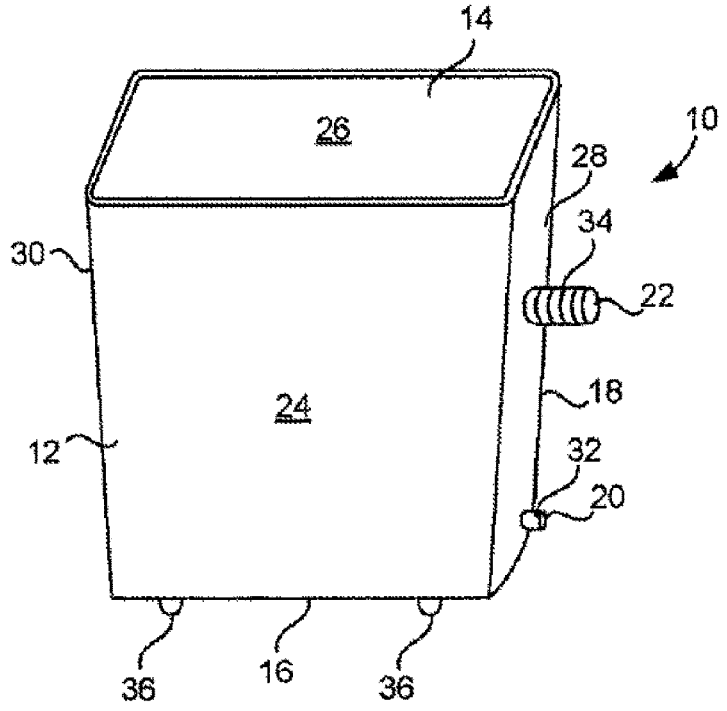
FIG. 1 is an upper perspective view of the cloth or rag washing bucket of the preferred embodiment of the present invention.

Referring to FIG. 1, there shown the cloth or rag washing bucket 10 in accordance with the preferred embodiment of the present invention. The cloth or rag washing bucket 10 includes a container 12 having an interior volume 14 defined by a bottom 16 at a wall 18 extending upwardly from the bottom 16. A fluid inlet 20 is affixed to the wall 18 adjacent to the bottom 16 of the container 12. The fluid inlet 20 is adapted be to be connected to a water hose. The fluid inlet 20 extends through the wall 18 of the container so as to have one end in the interior volume 14 and another end exterior of the wall 18 of the container 12. A fluid outlet 22 is formed on the container a location above a level of the fluid inlet 20. The fluid outlet is adapted to allow water from the interior volume 14 of the container 12 to flow outwardly of the container 12.

As can be seen in FIG. 1, the wall 18 of the container 12 has a pair of side walls 24 and 26 and a pair of end walls 28 and 30 extending between the pair of side walls 24 and 26. The container 12 has a generally rectangular configuration. The rectangular configuration is important to the proper operation of the present invention as will be described hereinafter. In other words, the rectangular configuration will cause the flow pattern of water that is introduced through the fluid inlet 20 have a bottom-to-top circular flow pattern for the aggressive and effective cleaning of the cloths or rags introduced into the interior of the cloth or rag washing bucket 10. If the container 12 was circular, the water flow would be in a cyclonic pattern. The cyclonic pattern would is certainly be effective for the cleaning of mops strings, but less effective in the cleaning of cloths or rags. In particular, it can be seen that the side walls 24 and 26 have a width dimension extending between the pair of end walls 28 and 30. Each of the pair of end walls 28 and 30 has a width dimension extending between the pair of side walls 24 and 26. The width dimension of each of the pair of side walls 24 and 26 is greater than the width dimension of each of the pair of end walls 28 and 30.

The fluid inlet (as will be described hereinafter) is a fitting that is affixed to the end wall 28. The fitting 20 will have a portion 32 on an exterior of the end wall 28 and will have a nozzle (to be described hereinafter) in the interior volume 14 of the container 12. The configuration of the fluid inlet 20 is described in greater detail herein in FIG. 5.

The fluid outlet 22 is an opening that is formed in the wall 28 of the container 12. In particular, the fluid outlet 22 includes a tubular member 34 that extends outwardly of the hole in the wall 28 of the container 12. The tubular member 34 is adapted to allow water to flow outwardly of the container in a location spaced away from the wall 28 of the container. If only a hole were placed into the wall 28 of the container, the water would tend to drain down the end wall 28 of the container in an unsightly fashion. After the container is removed from the drain, the water that resides on the end wall 28 will continue to drip. As such, the tubular member 34 is adapted so as to allow water to be released from the interior 14 of the container 12 in a location spaced away from the wall 18 of the container 12. As such, the exterior of the walls of the container will be generally free of moisture and water accumulation thereon.

It can be seen that the tubular member 34 has ridges formed thereon. These ridges are adapted to retain a conduit over an end of the tubular member. As such, if it is desired to place a hose or conduit around the tubular member 34 in order that the discharge of water from the interior volume 14 of the container 12 is passed to a remote location, the ridges on the tubular member 34 will accommodate the placement of such a hose or conduit. This is particularly effective if a drain is located far away from the placement of the washing bucket 10. It can be seen that the fluid inlet 20 and the fluid outlet 22, in the preferred embodiment, are on a common wall 24 of the container.

A plurality of feet 36 are affixed to the bottom 16 of the container 12 so as to extend outwardly from the bottom 16 of the container 12. The plurality of feet 36 can be simple plastic feet that are intended to support the container 12 in spaced relation above an underlying surface.

Figure 2:
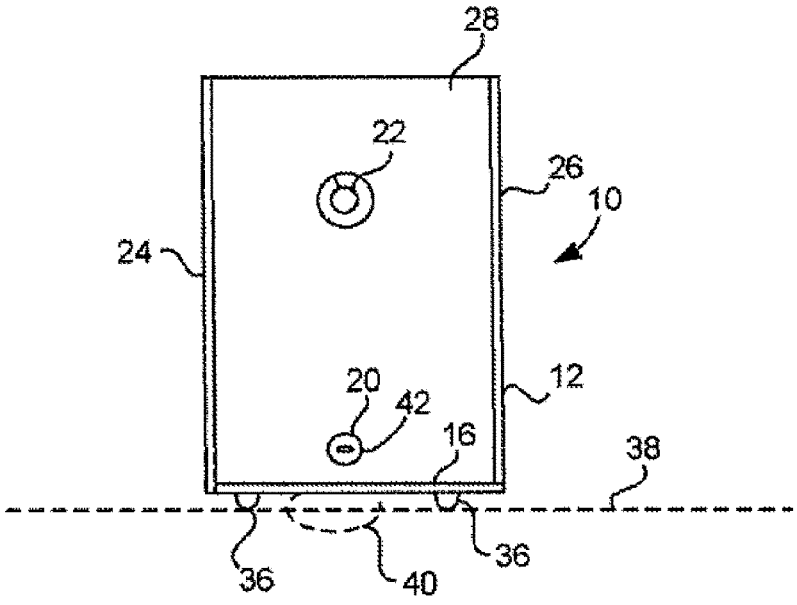
FIG. 2 is an end elevational view showing the placement of the cloth or rag washing bucket of the present invention upon an underlying surface.

FIG. 2 shows the placement of a cloth or rag washing bucket 10 of the present invention upon an underlying surface 38. In particular, the underlying surface 38 has a drain 40 thereon. The feet of the cloth or rag washing bucket 10 supports the bottom 16 of the container in spaced relation above the underlying surface 38. As such, when water is discharged through the fluid outlet 22, it will be discharged toward the underlying surface 38 and will migrate, eventually, toward the drain 40. Since the feet 36 serve the space the bottom away from the underlying surface 38, the bottom 16 will not block the drain 40 or create an impediment to the proper flow of water toward the drain.

In FIG. 2, it can be seen that the fluid inlet 20 has a nozzle 42 on the interior 14 of the container 12. This nozzle will be described in greater detail hereinafter. FIG. 2 also shows that the end wall 28 has a width dimension between the side walls 24 and 26 which is less than the width of the side walls 24 and 26 between the end walls 28 and 30.

Figure 3:
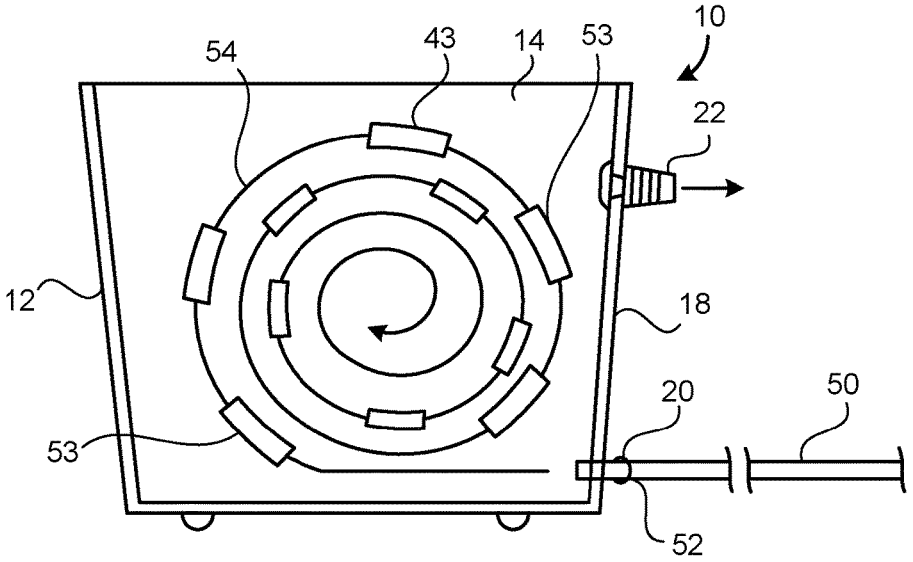
FIG. 3 is a cross-sectional view of the cloth or rag washing bucket of the present invention showing the bottom-to-top circulation pattern of water within the interior of the bucket.

FIG. 3 shows the cloth or rag washing bucket 10 having a water hose 50 affixed to the fluid inlet 20. The end of the fluid inlet 20 will have a hose fitting 52 on the end extending outwardly of the wall 18 of the cloth or rag washing bucket 10. The hose 50 will deliver water into the interior volume 14 of the container 12 in the manner shown in FIG. 3. The nozzle at the end of the fluid inlet 20 will create a bottom-to-top flow pattern in a circular manner as shown by line 54. This continuous circular flow pattern will cause the cloths or rags 53 within the water in the interior volume 14 of the container 12 to circulate upwardly and then downwardly continuously. This creates a unique washing operation that is particularly adapted the cleaning of cloths or rags. When a large number of cloths or rags are placed within the circulating water in the interior volume of the container 12, they will continue to rotate and be agitated by the circular bottom-to-top flow pattern. They will continue to move upwardly and downwardly as water is being discharged out of the fluid outlet 22. As such, continuous clean water will be introduced from the water hose 50 into the interior volume 14. Since dirt and debris tend to accumulate within the water in the container 14, the dirt and debris will ultimately be discharged, along with the water, outwardly of the fluid outlet 22 (as shown by the arrow adjacent thereto). The cloths for rags will always be subjected to hot clean water during the washing process. Experiments conducted with the present invention have shown that this bottom-to-top circular flow pattern greatly improves the efficiency of the cleaning of cloths and rags in an unexpected manner. It is believed that the upward motion and then the downward motion and then the upward motion of such cloths or rags tends to cause more water to be forced through each of the pores of the cloths and rags. This enhances the cleaning process. This cleaning process can continue without the use of detergents. As such, the environmental consequences and costs associated with such detergents is avoided.

In normal use, after a cleaning operation is carried out with the cloth or rag 53, it is thrown into the open top of the container 12 so that it enters the water in the container. It will then be caught into the circulation pattern of water within the container. Ultimately, a large number of cloths or rags can be introduced into this water flow pattern within the container 12. When a clean cloth or rag is desired, is only necessary for a user to grab one of the circulating rags 53 from the container 12. It is then ready for reuse. The system avoids the need for restaurants, and other businesses, to continuously stack or store dirty cloths or rags and then wait for a washing, rinsing and drying process to be carried out before reusing the cloths or rags. Once again, this saves on the cost of the cloths and rags, the detergents and the equipment used for the cleaning and rinsing of such cloths and rags.

Figure 4:
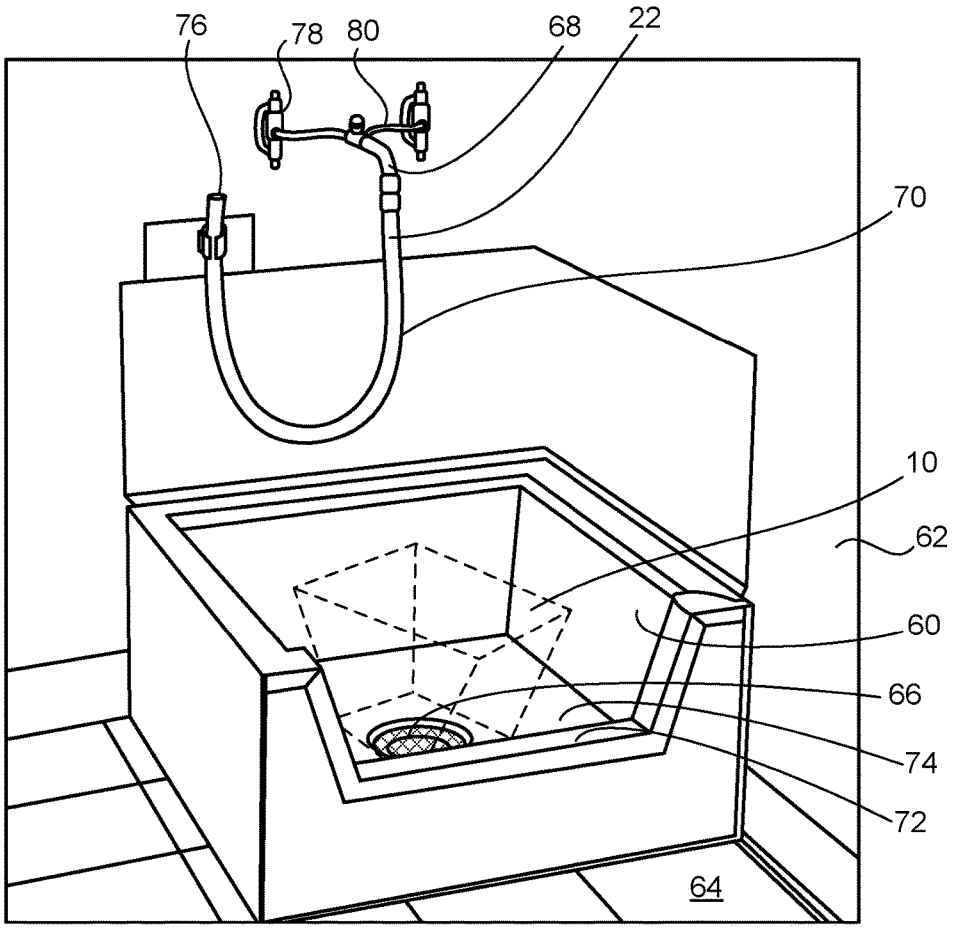
FIG. 4 is a perspective view showing the placement of the cloth or rag washing bucket of the present invention within a sink or drainage area in a janitorial closet.

FIG. 4 shows the cloth or rag washing bucket 10 and a broken-line fashion as placed within a sink 60 in a janitorial closet 62. Sink 60 can be in the nature of a drain fixture or it can be a sink that is supported a distance above the floor 64. A drain 66 is centrally placed within the sink 60. A water supply 68, along with a hose 70, is provided adjacent to the sink 60 in the janitorial closet 62.

Ultimately, in the process of the present invention, the cloth or rag washing bucket 10 can simply be lifted over the edge 72 and placed on the floor of the sink 60. Since the feet 36 support the bottom 16 of the container 12 a distance above the underlying surface, there is no problem with placing the cloth or rag washing bucket 10 directly over the drain 66. Ultimately, the hose 70 can be moved so that the end 76 can be joined to the hose fitting 52 on the fluid inlet 20. The hot water knob 78 on faucet 80 can be turned on so that hot water is delivered through the hose 70 and ultimately into the interior volume of the cloth or rag washing bucket 10. The cloths or rags 82 can then be lowered into the cloth or rag washing bucket 10 for continuous cleaning.

In normal use, cloths or rags will be introduced through the opening at the top of the container 12 and inserted into the water within the container 12. The cloths or rags will absorb water. Since the water hose 70 is connected to the faucet 80, hot water from the faucet 80 can be delivered through the hose 70 continuously into the interior of the container 12. As such, the cloths or rags will have hot water delivered thereto. The cloths or rags can then be used to clean surfaces. After a certain amount of time, the cloths or rags will be reintroduced to the opening at the top of the container 12 and back into the water of the container. The hot water within the container 12 will serve to separate grease and other debris from the cloths and rags. Since the nozzle of the fluid inlet 20 is directed generally adjacent to the bottom 16 of the container, a jet of water is provided to further assist in removing contaminants from the cloths or rags.

Ultimately, the dirt and debris that has been discharged from the cloths or rags in the water of the container 12 will continue to rise within the water in the container as the water continues to be introduced into the container 12 from the water hose 70 through the fluid inlet 20. Since water is continuously discharged through the fluid outlet 22, the debris will ultimately rise with the water until the contaminants reach the fluid outlet 22. These contaminants and debris can be discharged through the fluid outlet 22 and outwardly to a drain.

Importantly, in the present invention, the container 12 will have a relatively small size. This a very important for small establishments, such as fast food locations, convenience stores, and other small facilities. Relatively large containers, washers, and other devices are not required. The present invention will take up the space of a relatively small wastebasket. As such, it can be easily moved and stowed. Ultimately, the container will receive much less water. As such, the weight of the container, with the water therein, is relatively minimal. This container can be handled by a single individual by simply lifting the container (with the water therein) and moving the container and its water toward the drain. As such, the present invention can be provided at a much lower cost, can be transported more easily, and can be stored within a small facility in a minimal amount of space. This is accomplished while, at the same time, providing extremely effective cleaning action to cloths and rags.

Figure 5:
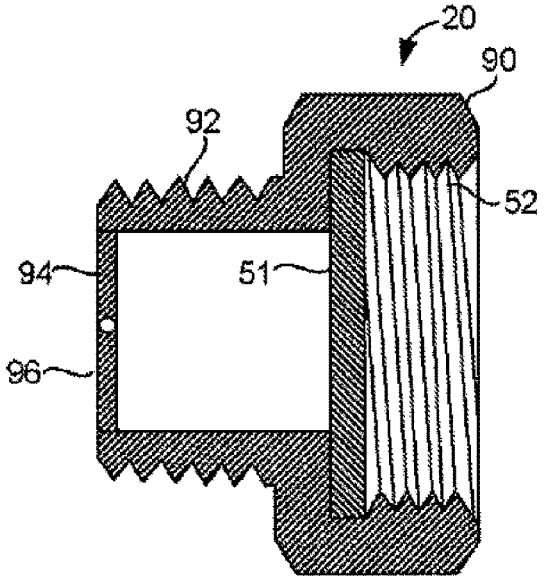
FIG. 5 is a cross-sectional view of the fluid inlet of the preferred embodiment of the present invention.

FIG. 5 shows the fluid inlet 20 as used in the present invention. It can be seen that the fluid inlet 20 has the hose fitting 52 at the end 90 that will extend outwardly of the wall 18 of the container 12. Ultimately, the threaded portion 92 can engage with the wall of the container in a liquid-tight manner. Alternatively, the wall 18 of the container 12 can be simply molded to the surfaces of the fluid outlet 12. The end 94 of the fluid outlet 20 includes a nozzle having a small aperture 96 therein. The small aperture is illustrated, in greater detail in FIG. 6. The fluid outlet 20 can further have a water reducer 51. The water reducer 51 is a generally flat disk of an elastomeric material. There is a hole that is formed through the water reducer 51. Ultimately, when the water hose is connected to the threads of the hose connector 52 of the fluid outlet 20, the pressure rise of the water flow from the water hose will flow through the interior passageway toward the water reducer 51. The only water that will flow past the water reducer 51 will be that water which passes through the hole of the water reducer 51. As such, the water reducer 51 serves to reduce the rate of water flow into the interior 18 of the container 12. The water reducer 51 assures that no matter how much pressure is directed by the water hose toward the container 12, only a limited amount of water will be released into the interior 18 of the container 12.

Figure 6:
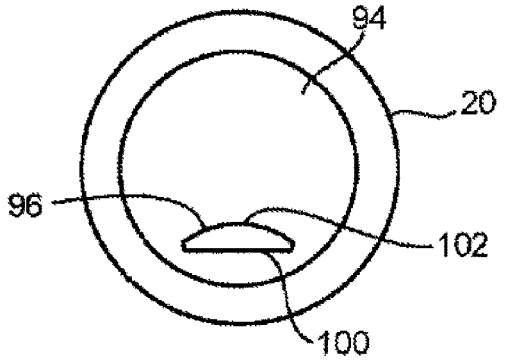
FIG. 6 is an end view of the fluid inlet of the preferred embodiment of the present invention.

FIG. 6 shows, in particular, the nozzle 96 that is formed at the end 94 of the fluid inlet 20. The nozzle 96 has a slot having a length dimension 100 extending parallel to the bottom 16 of the container 12 and a width dimension extending transverse to the bottom 16 of the container 12. It can be seen that the length dimension 100 of the slot is substantially greater than the width dimension of the slot. The nozzle 96 has its width dimension greater in the center 102 between the opposite ends of the length dimension 100 of the slot. The slot has a truncated ellipsoid shape.

The nozzle 96 is adapted to direct a pressurized flow of water toward an area adjacent to the bottom 16 of the container 12. It can be seen that the nozzle 96 has the shape of a chord of a circle. The straight edge 100 of the chord of the circle is below the curved portion 102. Experiments with this configuration of nozzle have shown that it creates a strong laminar flow of water in a straight direction adjacent to the bottom 16 of the container 12. The curved portion 102 of the nozzle 96 creates a strong flow that tends to spread slightly upwardly from the bottom 16 of the container 12. As such, these flows of water tend to interact with the surfaces of cloths and rags so as to forcibly remove debris from the cloths or rags or from the pores of such cloths or rags. This configuration of slot also creates the bottom-to-top flow pattern of water within the interior 18 of the container 12.

Figure 7:
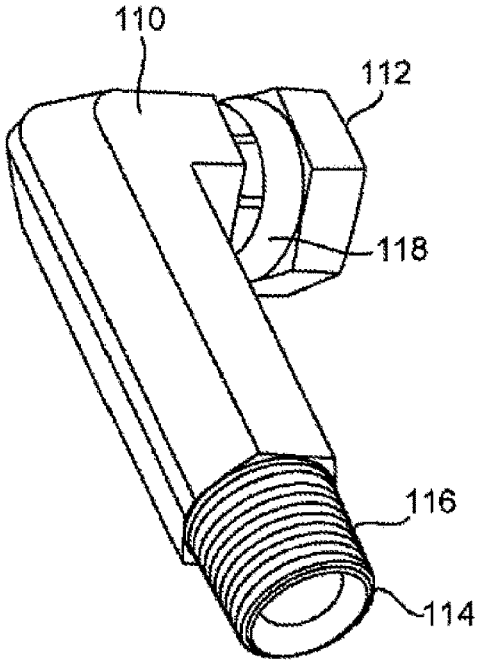
FIG. 7 is a perspective view of an alternative embodiment of the fluid outlet of the present invention.

FIG. 7 shows one configuration of a pipe 110 that can be used with the fluid outlet 22 of the present invention. FIG. 7 shows a swivel pipe 110 having one end 112 that can be affixed to the fluid outlet 22 and an opposite end 114 that has threads 116 suitable for securing to a conduit. The elbow swivel 110, as shown in FIG. 7, can be movable about pivot joint 118 between a first position extending upwardly and a second position extending downwardly. When the elbow swivel 110 is in the downward position, it is suitable for delivering water flowing from the interior 18 of the container 12 toward an underlying surface. On the other hand, when the elbow swivel 110 is in the upper position (to which the end 114 is located above the swivel joint 118), it will allow the cloth or rag washing bucket 10 to be used as a conventional bucket. In other words, if a cap were placed over the fluid inlet 20 so as to close the fluid inlet, a continuous supply of water is not being delivered into the interior 18 of the container 12. Since the elbow swivel 110 has its end 118 above the level of water within the bucket, the water will pass outwardly of the end 28. As such, this easily allows one to convert the continuous-flow washing bucket 10 of the present invention into a conventional bucket.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A cloth or rag washing bucket comprising:

a container having an interior volume defined by a bottom and a wall extending upwardly from the bottom, said container having an upper edge opposite the bottom, the interior volume adapted to receive the cloth or rag therein;

a fluid inlet affixed to the wall of said container adjacent to the bottom of said container, said fluid inlet adapted to be connected to a water hose, said fluid inlet extending through the wall of the container so as to have one end in the interior volume of said container and another end exterior of the wall of said container, said fluid inlet communicating with the interior volume of said container, said fluid inlet comprising:

a fitting affixed to the wall of said container, said fitting having a hose connector on an end exterior of the wall and a nozzle at the end in the interior volume of said container, wherein the nozzle has a slot with a length dimension extending parallel to the bottom of said container and a width dimension extending transverse to the bottom of said container, the length dimension of the slot being substantially greater than the width dimension of the slot, wherein said fluid inlet passes pressurized water into the interior volume of said container such that the cloth or rag is washed solely by the flow of the pressurized water into said container; and a fluid outlet formed on said container at a level above a level of the fluid inlet so as to open through the wall of said container, said fluid outlet adapted to allow water in the interior volume of said container to flow outwardly of said container, the level of said fluid outlet positioned below a lowest level of the upper edge of said container.

2. The cloth or rag washing bucket of claim 1, wherein the wall of said container has a pair of side walls and a pair of end walls extending between the pair of side walls so as to have a generally rectangular configuration.

3. The cloth or rag washing bucket of claim 2, each of the pair of side walls having a width dimension extending between the pair of end walls, each of the pair of side walls having a width dimension extending between the pair of end walls, the width dimension of each of the pair of side walls being greater than the width dimension of each of the pair of end walls.

4. The cloth or rag washing bucket of claim 2, wherein said fluid inlet and said fluid outlet are on a common end wall or side wall of said container.

5. The cloth or rag washing bucket of claim 1, wherein the width dimension of the slot is greatest between opposite ends of the length dimension of the slot.

6. The cloth or rag washing bucket of claim 5, wherein the slot has a truncated ellipsoid shape.

7. Cloth or rag washing bucket of claim 1, wherein said fluid outlet has a tubular member extending outwardly of a hole in the wall of said container, the tubular member being adapted to allow water to flow outwardly of said container to a location spaced away from the wall of said container.

8. The cloth or rag washing bucket of claim 7, wherein the tubular member having ridges thereon, the ridges being adapted to retain a conduit over an end of the tubular member.

9. The cloth or rag washing bucket of claim 1, further comprising:

a pair of feet affixed to the bottom of said container so as to extend downwardly from the bottom of said container, said pair of feet adapted to support said container in spaced relation above an underlying surface.

10. The cloth or rag washing bucket of claim 1, further comprising:

a water hose connected to said fluid inlet, said fluid inlet defining a nozzle that directs water under pressure from said water hose into the interior volume of said container in a bottom-to-top circular pattern.

11. The cloth or rag washing bucket of claim 1, said fluid outlet comprising:

a pipe affixed to the wall of said container, said pipe having an end extending outwardly of the wall of said container.

12. The cloth or rag washing bucket of claim 11, wherein said pipe has a generally L-shape.

13. The cloth or rag washing bucket of claim 12, wherein said pipe is pivotally mounted to said container such that an end of said pipe can be directed in a desired direction.

14. A cloth or rag washing bucket comprising:

a container having an interior volume defined by a bottom and a wall extending upwardly from the bottom, said container having an upper edge opposite the bottom, the interior volume adapted to receive the cloth or rag therein;

a fluid inlet affixed to the wall of said container adjacent to the bottom of said container, said fluid inlet extending through the wall of said container so that one end is in the interior volume of said container and another end extends exterior of the wall of said container, said fluid inlet communicating with the interior volume of said container, said fluid inlet comprising:

a fitting affixed to the wall of said container, said fitting having a hose connector on an end exterior of the wall and a nozzle at the end in the interior volume of said container, wherein the nozzle has a slot with a length dimension extending parallel to the bottom of said container and a width dimension extending transverse to the bottom of said container, the length dimension of the slot being substantially greater than the width dimension of the slot;

a fluid outlet formed on said container at a level above a level of said fluid inlet so as to open through the wall of said container, said fluid outlet adapted to allow water from the interior volume of said container to flow outwardly of said container, the level of said fluid outlet positioned below a lowest level of the upper edge of said container; and a water hose connected to said fluid inlet, said fluid inlet defining a nozzle that directs water under pressure from said water hose into the interior volume of said container in a bottom-to-top circular pattern such that the cloth or rag is washed solely by the water directed under pressure into the interior volume of said container.

15. The cloth or rag washing bucket of claim 14, the wall of said container having a pair of side walls of a pair of end walls extending between the pair of side walls so as to define a generally rectangular configuration.

* * * * *